United States Patent [19]

Dielissen

[11] Patent Number: 5,057,008

[45] Date of Patent: Oct. 15, 1991

[54] LINE BURNER

[75] Inventor: Gerardus C. Dielissen, Keerbergen, Belgium

[73] Assignee: Maxon International n.V., Belgium

[21] Appl. No.: 657,342

[22] Filed: Feb. 15, 1991

Related U.S. Application Data

[63] Continuation of Ser. No. 385,803, Jul. 26, 1989, abandoned.

[30] Foreign Application Priority Data

Jul. 26, 1988 [EP] European Pat. Off. ..... 88111991

[51] Int. Cl.[5] ..... F23A 14/22

[52] U.S. Cl. ..... 431/351; 431/10; 431/350

[58] Field of Search ..... 431/10, 12, 159, 353, 431/349, 351, 352, 350; 126/39 R, 85 R, 116 R

[56] References Cited

U.S. PATENT DOCUMENTS

| | | | |
|---|---|---|---|
| 3,340,180 | 7/1982 | Belknap et al. . | |
| 3,649,211 | 3/1972 | Vosper | 431/350 X |
| 4,403,947 | 9/1973 | Spielman . | |
| 4,531,904 | 7/1985 | Sato et al. | 431/10 |
| 4,610,626 | 9/1986 | Kikotani et al. | 431/352 X |

FOREIGN PATENT DOCUMENTS

| | | | |
|---|---|---|---|
| 1591994 | 11/1968 | France | 431/352 |
| 0032836 | 3/1979 | Japan | 431/10 |
| 0087514 | 6/1982 | Japan | 431/350 |

OTHER PUBLICATIONS

Bulletin H-130, Aug. 1987, Eclipse Ratio-Flame Burners, Series NML, Eclipse Combustion, Rockford, Ill., 61103.

*Primary Examiner*—Carl D. Price

*Attorney, Agent, or Firm*—Barnes & Thornburg

[57] ABSTRACT

Serving drying and gas cleaning processes, and thus also the intermediate heating of gas or flue gas, is a line burner where the fuel gas is fed through a fuel gas pipe and a fuel gas feed to fuel gas manifolds that extends lengthwise in a burner housing and in which fuel gas ports are provided. The necessary primary combustion air flow proceeds through an air manifold, after passing a diffuser plate and an orifice plate into a mixing zone adjacent to the fuel gas ports. Parallel with it, combustion air is fed past the fuel gas manifolds through additional combustion air channels, generating secondary flows of combustion air. Upon flowing around the fuel gas manifolds, these secondary flows are fed to the flame, effecting a dual-stage combustion. Extension plates support angle irons hich lie in spaced relation to the fuel gas manifolds to form a pair of combustion air channels for conducting a portion of the combustion air around the fuel gas manifolds to a downstream location. The extension plates prevent a backup of inert gas into the flame. Thus, airflows or gas flows with high $CO_2$ and $H_2O$ contents can be safely dried or reheated.

22 Claims, 2 Drawing Sheets

3'
12
21
7
6
8
20
2
3
14
15
16
17
5
10
19
18
11
4
13
1

LINE BURNER

This application is a continuation of Ser. No. 07/385,803, filed on Jul. 26, 1989, now abandoned.

BACKGROUND AND SUMMARY OF THE INVENTION

This invention relates to line burners, and particularly to a line burner having a fuel gas manifold for providing fuel gas to be burned to produce a flame and systems for supplying combustion air to both of the upstream and downstream sides of the fuel gas manifold and for removing inert gases from the flame.

Conventional line burners are suited for regular drying and flue gas cleaning processes and similar processes when the air flow contains sufficient oxygen. See, for example, U.S. Pat. No. 4,340,180 to Belknap et al. relating to a nozzle mixing line burner. If this is not the case and a high content of $H_2O$ and $CO_2$ is present, conventional line burners are known to fail or operate in an unsatisfactory manner. Such circumstances occur, e.g., in power plants where the process air must be reheated before it passes over a catalyst for reduction of the $NO_x$ content. Due to ever more stringent regulations for the operation of power plants, for instance with hydrogen sulfide washers, there is a shortage of suitable systems for assuring a sufficient reduction of the $NO_x$ content.

The problem underlying the invention is to provide a burner that operates properly under unfavorable conditions, especially with process air having a high $CO_2$ content.

This problem is inventionally solved in that each fuel gas manifold is arranged in a burner housing so as to be sandwiched between a primary and secondary combustion air flow channel and that extension plates are connected to the burner housing to help remove inert gas from the region of the burner housing containing the flame.

What is accomplished through the extension plates in a surprisingly simple and safe way is that the flame generated by the line burner is protected from being smothered by inert gas associated with combustion air, thus assuring favorable conditions for a complete combustion. These expansion and extension plates provide sort of a chimney effect so that a backup of the inert gas is safely avoided. The specific routing of the combustion airflow in the area of the fuel gas manifolds has a multiple effect insofar as the fuel gas manifolds are favorably cooled by the flow of combustion air, with the flame being protected at the same time by the combustion air flow sweeping around it, thus preventing inert gas from penetrating into the area of the burner or flame. But assured as an additional effect, surprisingly, is most of all a limitation of $NO_x$ production, since the combustion occurs substantially in two steps. Namely, the combustion occurs in the area of the fuel gas orifices in an orifice plate and situated between the fuel gas manifolds at the point where the combustion air flow, after sweeping across the fuel gas manifolds, returns to the area of the flame, as sort of an afterburn.

With the present invention, it is thus possible in a surprisingly safe way to heat process air with a high $CO_2$ and $H_2O$ content, also under unfavorable conditions in the realm of power plants, to a degree such that they can subsequently be passed across the catalyst and brought in contact with it in order to filter off further pollutants safely, so that optimally cleaned flue gases can be Passed into the atmosphere.

According to the present invention, a line burner is provided for mixing fuel gas and combustion air to produce a burnable mixture. The line burner includes a burner housing, a pair of fuel gas manifolds situated to lie in spaced apart relation inside the burner housing, and means for supplying fuel gas to the pair of fuel gas manifolds. Means is also provided for mounting the pair of fuel gas manifolds in the burner housing to form a primary airflow channel located between the fuel gas manifolds and a secondary airflow channel located between at least one of the fuel gas manifolds and the burner housing. Each fuel gas manifold is arranged to extend longitudinally along a length of the burner housing. Each fuel gas manifold is formed to include a plurality of fuel gas ports discharging laterally into the primary airflow channel and toward the opposite manifold to provide streams of fuel gas for use in combustion.

The line burner further includes first means for supplying combustion air via the primary airflow channel provided in the burner housing to an upstream side of the fuel gas ports formed in the at least one fuel gas manifold. Combustion air supplied by the first means mixes with the streams of fuel gas discharged through the fuel gas ports in a first air and fuel mixing region. Second means is also provided for supplying combustion air via the secondary airflow channel formed in the burner housing to a downstream side of the fuel gas ports formed in the at least one fuel gas manifold. Combustion air supplied by the second means mixes with a mixture developed in the first air and fuel mixing region in a downstream second air and fuel mixing region. In operation, a first stage of combustion occurs in the first air and fuel mixing region and a second stage of combustion occurs in the second air and fuel mixing region.

In preferred embodiments, the line burner further includes an orifice plate arranged to extend longitudinally along the length of the burner housing between the fuel gas manifolds. The orifice plate is formed to include air orifices therein for providing streams of combustion air transverse to said fuel gas streams directed laterally from the fuel gas ports. The orifice plate is fixed to lie in the primary airflow channel upstream of the first air and fuel mixing region. The second means provides an air-conducting passageway in the burner housing that is configured to bypass the orifice plate so that combustion air is conducted through the secondary airflow channel to reach the second air and fuel mixing region without passing through the air orifices formed in the orifice plate.

The line burner further includes chimney means fixed to the burner housing for providing a flue to carry off inert gases collecting in the first and second air and fuel mixing regions. The chimney means includes a pair of extension plates aligned in spaced apart relation to define the flue. The pair of fuel gas manifolds are situated to lie in the flue between the pair of extension plates. The mounting means connects each of the fuel gas manifolds to a companion one of the extension plates.

Each fuel gas manifold is situated to lie adjacent to the first means and one of the second means in heat transferring relation. This arrangement advantageously permits heat energy from the fuel gas supplied to the fuel gas manifolds to be transferred to the combustion air conducted through the first and second means to cool the fuel gas manifolds during operation of the line burner.

Angle irons are arranged on the outside of the fuel gas manifolds and spaced from them. To enable a favorable arrangement of the extension plates and also to achieve a pair of combustion air flow channels around the combustion gas manifolds. The arrangement and extension of these angle irons is such that the combustion air flow will be passed specifically about the fuel gas manifolds and that air is then introduced into the flame area, from a position downstream of the fuel gas manifolds in a second combustion stage. To that end, the angle iron is equipped with a mounting flange. The two flanges protrude from the web in an opposite arrangement.

To make it possible to change the size of the combustion air flow channels according to requirements, means is provided for arranging the angle irons on the burner housing so that the angle irons are detachable and movable transverse to the longitudinal direction. The combustion air flow channel which partly encompasses the fuel gas manifolds can then be so varied, through loosening and moving the angle irons, that either more or less combustion air will pass through this channel and be directed at the flame. A flow-diverting flange of the angle iron may additionally feature subdivisions or appropriate webs for specifically dividing the airflow that leaves the combustion airflow channel.

The invention is specifically characterized by providing a burner which under unfavorable conditions, specifically at high $CO_2$ and $H_2O$ contents, can be operated safely. A surprising multiple result is achieved in that a backup of inert gas into the area of the burner of the flame is precluded, simultaneously through the arrangement of extension plates and the specific routing of the combustion air flow. The specific routing of the combustion airflow results in further effects insofar as a cooling of the combustion air devices is accomplished along with a combustion in two steps, since the combustion airflow channel is arranged spaced behind the orifice plate for the combustion air and once again feeds combustion air to the flame. A distinct reduction of the $NO_x$ content of such gases is thus surprisingly guaranteed. Especially in the desulfurization of flue gas in power and similar plants, considerable problems existing there can be solved this way, with the prior design of the burner permitting a favorable integration in the new development.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
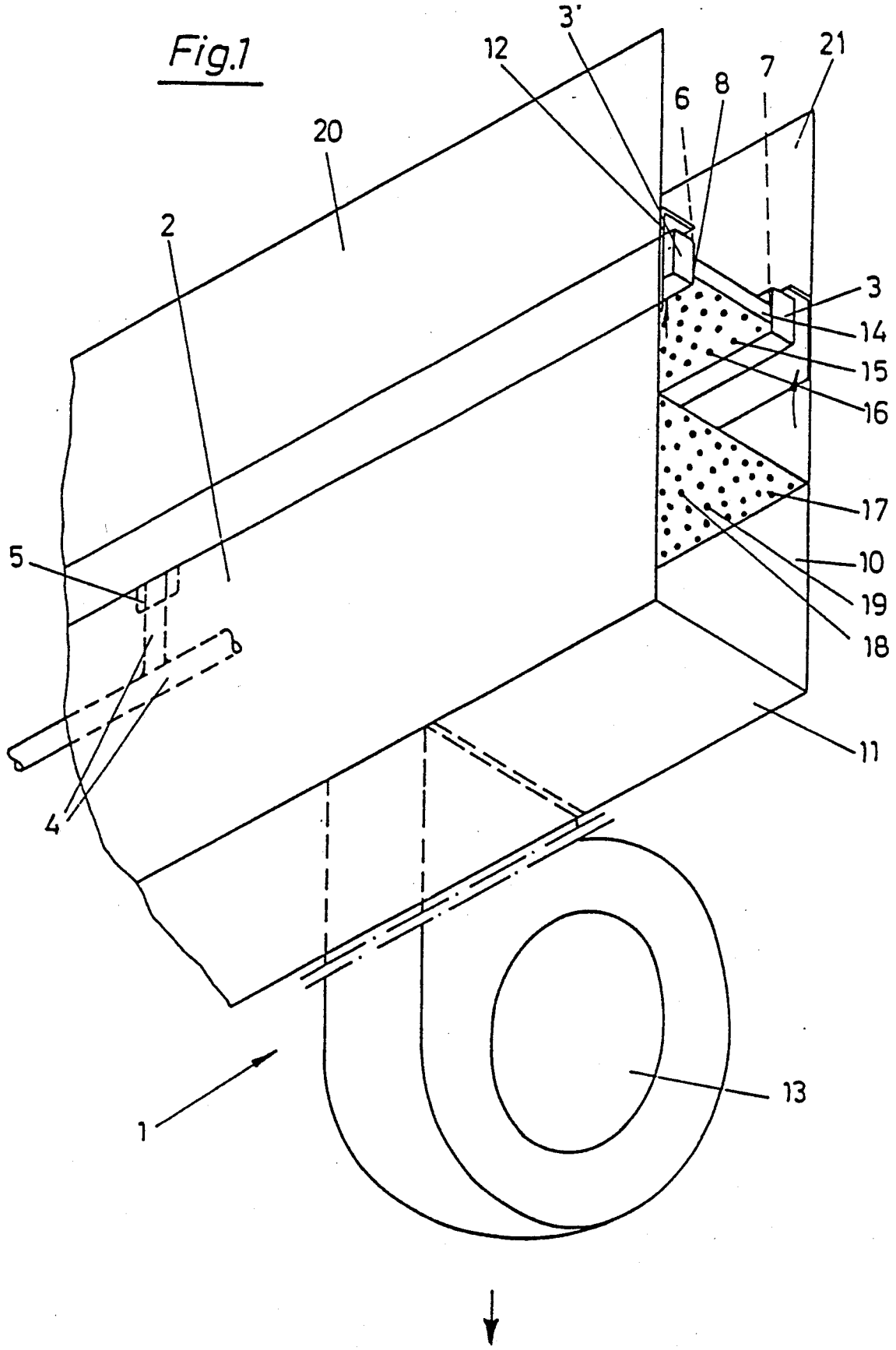
FIG. 1 shows a perspective view of a line burner with an accessory air feed device.

Referring to FIG. 1, a line burner 1 in accordance with the present invention includes a pair of fuel gas manifolds 3, 3' arranged in a sheet metal housing 2 to lie opposite one another in spaced relation. Each of the fuel gas manifolds extends longitudinally along the line of the burner 1 and is fixed through a bracket to a side wall of the housing 2. Each fuel gas manifold 3, 3' is connected to a fuel gas pipe 4 and the fuel gas feed 5 so as to guarantee a uniform gas feeding.

Figure 2:
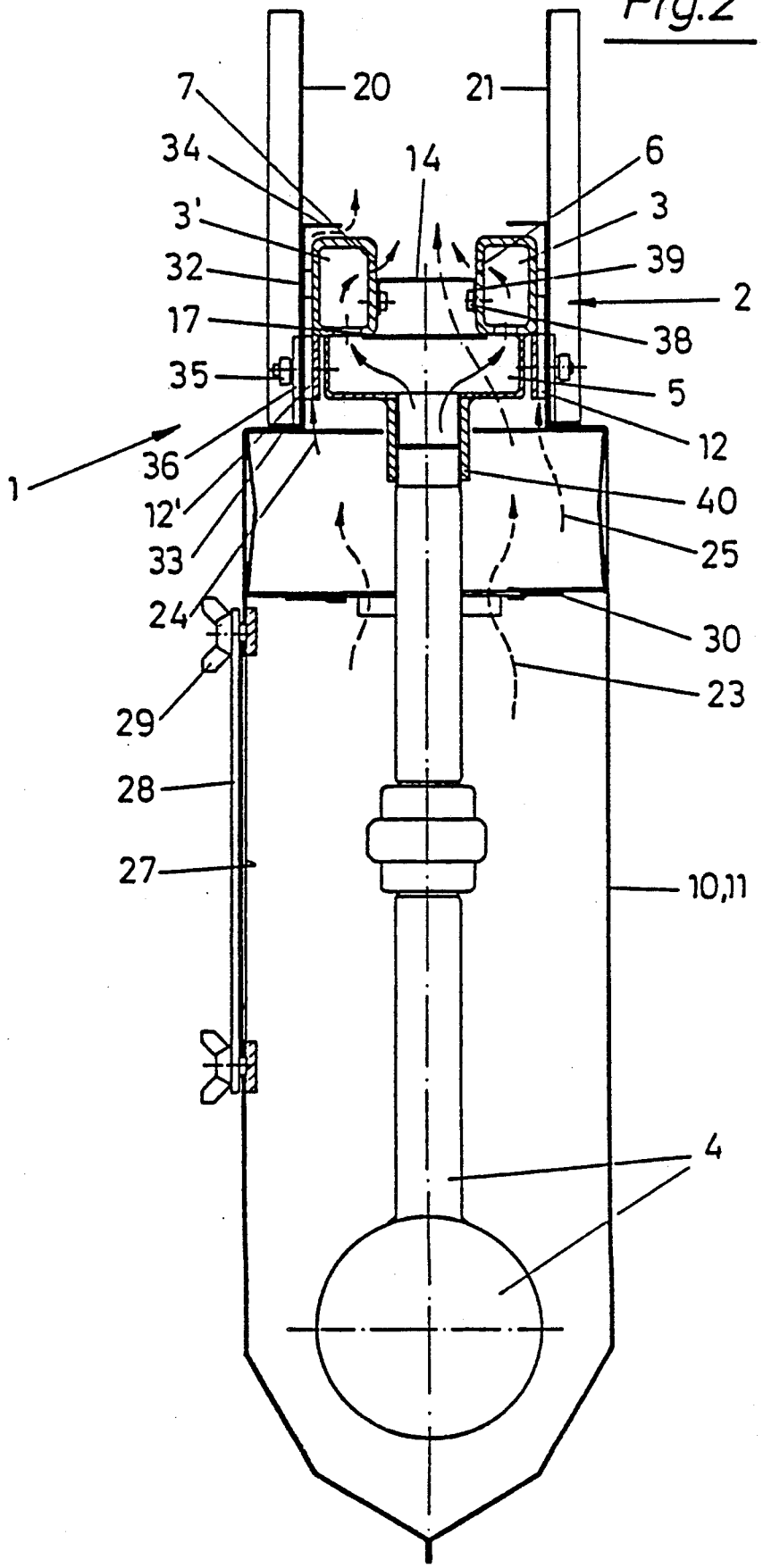
FIG. 2 shows a cross section of a burner without an accessory air feed device.

Each of the fuel gas manifolds 3, 3' has an inwardly facing side wall 8 that is formed to include a plurality of fuel gas ports 6, 7, as shown best in FIG. 2. Each of the fuel gas ports 6, 7 discharges laterally and toward the opposite manifold to provide streams of fuel gas in the region between the fuel gas manifolds 3, 3' along the length of line burner 1. The fuel gas ports 6, 7 are arranged to cause fuel gas discharged therethrough to be mixed intensively with the combustion airflow.

The required combustion air is introduced into the burner housing 2 through an air manifold 10. A housing 11 of appropriately large dimension is provided to contain air manifold 10. Housing 11 includes an upper area configured to support the fuel gas manifolds 3, 3'. A primary combustion air channel is provided to cause a portion of the combustion air flow to pass between the fuel gas manifolds 3, 3' as shown by one of the dotted line representations of an airflow in FIG. 2. Secondary combustion air channels 12 are provided to cause a portion of the combustion airflow to be passed around the fuel gas manifolds 3, 3' as shown by the dotted line representation of an airflow above fuel gas manifold 3' in FIG. 2.

The required combustion air for a burner such as line burner 1 is usually derived from outside, for instance to reheat once more the airflows containing high ratios of $CO_2$ and $H_2O$ prior to being passed to the catalyst. Thus, the blower means 13 illustrated in FIG. 1 is intended to function as an accessory air feed device.

An orifice plate 14 extends longitudinally along the line of burner 1 as shown best in FIG. 1 and between the pair of fuel gas manifolds 3, 3' to lie in the primary combustion air channel. Air orifices 15, 16 are provided in orifice plate 14 to communicate a portion of the air in air manifold 11 to the fuel streams directed laterally from fuel gas manifolds 3, 3' through fuel gas ports 6, 7.

The orifice plate 14 with the appropriate orifices 15, 16 for the combustion air is arranged closely below the fuel gas ports 6, 7 in the fuel gas manifolds 3, 3'. The orifice plate 14 is arranged in the area of the fuel gas ports 6, 7 and detachable from the inwardly facing wall 8 of the fuel gas manifolds 3, 3'. This makes it possible to install orifice plates 14 with different perforation patterns in accordance with requirements. Also, it is possible to alter the position of orifice plate 14 in such a way that the discharging combustion airflows will proceed in a more or less centered way in the area of the fuel gas orifices 15, 16, whereby a variation of the flame is possible if required.

In preferred embodiments, air diffuser means is provided for controlling the flow of air to the air orifices 15, 16 of the orifice plate 14. The diffuser means preferably comprises a diffuser plate 17 having a plurality of perforations 18, 19 therein. These perforations 18, 19 extend along the length of the diffuser plate 17 to promote uniformity of airflow to the air orifices 15, 16. Air enters the Perforations 18, 19 in diffuser plate 17 from air manifold 10.

A pair of extension plates 20, 21 are provided on housing 11 as shown best in FIG. 2 and aligned in spaced-apart parallel relation to hold the fuel gas manifolds 3, 3', orifice plate 14, and diffuser plate 17 therebetween. Influences on the flame created by line burner 1 in the area of the fuel gas manifolds 3, 3' are minimized by extension plates 20, 21. Thus, extension plates 20, 21 cooperate to provide a chimney on housing 11 for conducting inert gases away from the fuel gas manifolds 3, 3' so that inert gas cannot flow into the area of the flame. Rather, the heated gas is removed, specifically and without influencing passage of fuel gas through fuel gas orifices 6, 7 or passage of combustion air through orifice plate 14.

Line burner 1 is configured to divide combustion airflow 23 received from air manifold 10 into a primary airstream constrained to flow through orifice plate 14 in a space between the fuel gas manifolds 3, 3' and secondary airstreams 24, 25 constrained to flow around fuel gas manifolds 3, 3' through combustion air channels 12, 12' thereby bypassing the orifice plate 14. The primary airstream mixes with fuel gas discharged through fuel gas ports 6, 7 to create an upstream first air and fuel mixing zone. The secondary airstreams conducted through combustion air channels 12, 12' merge with the air and fuel mixture created in the upstream first mixing zone at a second mixing zone located downstream of the fuel gas ports 6, 7.

As shown best in FIG. 2, fuel gas manifold 3' and extension plate 20 cooperate to define secondary combustion air channel 12' therebetween and fuel gas manifold 3 and extension plate 21 cooperate to define secondary combustion air channel 12 therebetween. Further, angle irons 32 function to direct the secondary airstreams 34, 25 conducted through combustion air channels 12', 12 in an inward direction toward one another and into the downstream second mixing region as explained in greater detail below. A tail can be added to each of the fuel gas manifolds 3, 3' to increase the length of the combustion air channels 12', 12 as shown in FIG. 2.

The secondary airstreams 24, 25 are inventionally passed close to the fuel gas manifolds 3, 3' in order to cool the fuel gas manifolds 3, 3' and "behind" the fuel gas manifolds 3, 3' to feed additional combustion air once more to the flame downstream of fuel gas ports 6, 7. FIG. 2 evidences the dual-stage combustion that is achieved thereby, which on account of its optimized design results in a distinct and considerable reduction of the $NO_x$ content.

A side opening 27 is provided in the housing 11 and is sealed by a plate 28 that is fixed on the housing 11 by means of mounting screws 29. To enable in a simple way the supply of additional combustion air, the housing 11 features the side opening 27 which is sealed by the detachably mounted plate 28. The side opening 27 serves at the same time as an inspection opening making it possible to perform any necessary service work in the area of the burner.

The spacing between housing wall and fuel gas pipe 4 and other devices is assured through the spacer plate 30 which, as illustrated, specifically guarantees an air flow closely by the fuel gas pipe 4. Another variation is such that the spacer plate 30 can be formed to provide a diffuser effect, i.e., a specific mixing and uniformization of the air flow as such. In respect of cooling the fuel gas feed devices, a favorable effect is obtained by fixing the fuel gas pipe 4 in the housing 11 by at least one spacer plate 30 which at the same time is designed to serve as a diffuser plate. The diffuser effect is specifically generated in a direction so as to pass the combustion air closely by the fuel gas pipe 4 and the remaining devices and to have at the same time a uniformly mixed combustion air available. In such an embodiment, the actual diffuser plate 17 is then located in the area of the orifice plate 14 as shown, for example, in FIG. 2.

Each angle iron 32 includes a mounting flange connected to the burner housing 2 and a flow-diverting flange 34 extending in an inward direction to cause the secondary airstreams 24, 25 diverted around the fuel gas manifolds 3, 3' to be passed around the fuel gas manifolds 3, 3' and again toward the flame, thereby achieving the dual-stage combustion. In the illustrated embodiment, one angle iron 32 is mounted on extension plate 20 to define combustion air channel 12' therebetween and the other angle iron 32 is mounted on extension plate 21 to define combustion air channel 12 therebetween.

Another favorable embodiment of the invention provides for an extendable design of the flow-diverting flange 34 of the angle iron 32. This enables a specific routing of the combustion airflow 24, 25, depending on how this is optimal for maintaining the flame. The flow-diverting flange 34 is extended either up to the corresponding front edge of the respective fuel gas manifold 3, 3', or even farther, or it ends already before, depending on whether an additional combustion or protection from inert gas is the essential objective for the introduction of the additional combustion airflow.

Another possibility for specifically generating secondary combustion airflow channels 12, 12' is that of arranging the extension plates 20, 21 on the burner housing 2 so as to define the combustion air channels 12, 12' to the fuel gas manifolds 3, 3'. Thus, the extension plates 20, 21 serve a dual purpose where they can define through their appropriate arrangement, namely their movable arrangement, also the size of the combustion air channels 12, 12' in accordance with requirements. In this connection, the extension plates 20, 21 should suitably be provided with cross webs in order to achieve a reversal of the combustion airflow around the fuel gas manifolds and toward the flame.

The angle irons 32 are favorably mounted on the extension plates 20, 21 in movable fashion. Thus, the angle irons 32 form the combustion airflow channels 12, 12', and the extension plates 20, 21 as such can be shifted more or less far for routing the heated airflow or flue gas flow. In the lower area, the angle irons 32 thus can substantially also perform the job of the extension plates 20, 21 or form together with the extension plates 20, 21 a system unit. This achieves a favorable variation in all directions.

Provided for the simultaneous fixing and mounting of the angle iron 32 and extension plates 20, 21 is a screw connection 35, which together with a bracket 36 provides the possibility to either move the angle iron 32 or the extension plates 20, 21, or also both, depending on where and how a change of the combustion air channel 12 or of the fuel gas routing is desired or necessary.

Above it was explained that the components such as angle irons 32 and extension plates 20, 21 are detachably connected with one another respectively with the housing 11 or the burner body 2. The orifice plate 14 is preferably fastened also through a screw connection 38 on the fuel gas manifolds 3, 3' in such a way that an alteration is possible here. In the embodiment illustrated in FIG. 2, the orifice plate 14 is designed as a U-shaped longitudinal plate having flanges 39 providing the detachable connection by means of screws 38. This makes it possible to change the position of the orifice plate 14 as required or, however, replace it with another one.

The assembly of the entire burner 1 is further facilitated in that a socket 40 provides the connection of the fuel gas pipe 4 with the fuel gas feed 5 and, thus, with the actual burner 1, with an appropriate insertion of the fuel gas pipe 4 in the socket 40 providing a sufficiently safe seal and connection.

Although the invention has been described in detail with reference to certain preferred embodiments, variations and modifications exist within the scope and spirit of the invention as described and defined in the following claims.

What is claimed is:

1. A line burner, comprising a burner housing including a pair of spaced-apart interior side walls, means for passing a stream of combustion air in the burner housing along each of said pair of spaced-apart interior side walls to provide a pair of spaced-apart curtains of air, a pair of elongated fuel gas manifolds arranged to lie in a space between the pair of spaced-apart curtains of air and in spaced-apart relation to define a channel therebetween, each of said pair of elongated fuel gas manifolds formed to include a plurality of fuel gas ports, and means for supplying combustion air through the channel provided between the pair of fuel gas manifolds to mix in the channel with fuel gas discharged from said fuel gas ports of the pair of fuel gas manifolds to create an air and fuel gas mixture that is ignitable to produce a flame in the burner housing in said space between the pair of spaced-apart curtains of air.

2. A line burner comprising a burner housing, a pair of fuel gas manifolds situated to lie in spaced relation inside the burner housing, means for supplying fuel gas to the pair of fuel gas manifolds, means for mounting the pair of fuel gas manifolds in the burner housing to form a primary airflow channel located between the fuel gas manifolds and a secondary airflow channel located between at least one of the fuel gas manifolds and the burner housing, each fuel gas manifold extending longitudinally along a length of the burner housing, and each fuel gas manifold being formed to include a plurality of fuel gas ports discharging laterally into the primary airflow channel and toward the opposite manifold to provide streams of fuel gas for use in combustion, first means for supplying combustion air via the primary airflow channel to an upstream side of the fuel gas ports formed in the at least one fuel gas manifold to mix with the streams of fuel gas discharged through the fuel gas ports in a first air and fuel mixing region, and second means for supplying combustion air via the secondary airflow channel to a downstream side of the fuel gas ports formed in the at least one fuel gas manifold to mix with a mixture developed in the first air and fuel mixing region in a downstream second air and fuel mixing region so that a first stage of combustion occurs in the first air and fuel mixing region and a second stage of combustion occurs in the second air and fuel mixing region.

3. The line burner of claim 2, further comprising an orifice plate extending longitudinally along the length of the burner housing between the fuel gas manifolds, the orifice plate being formed to include air orifices therein for providing streams of combustion air transverse to said fuel gas streams directed laterally from the fuel gas ports, and the orifice plate being fixed to lie in the primary airflow channel upstream of the first air and fuel mixing region.

4. The line burner of claim 3, wherein the second means is arranged in the burner housing to bypass the orifice plate so that combustion air is conducted through the secondary airflow channel to reach the second air and fuel mixing region without passing through the air orifices formed in the orifice plate.

5. The line burner of claim 2, further comprising chimney means fixed to the burner housing for providing a flue to carry off inert gases collecting in the first and second air and fuel mixing regions.

6. The line burner of claim 5, wherein the primary and secondary airflow channels are disposed in the flue defined by the chimney means.

7. The line burner of claim 5, wherein the chimney means includes a pair of extension plates aligned in spaced apart relation to define the flue, the pair of fuel gas manifolds are situated to lie in the flue between the pair of extension plates, and the mounting means connects one of the fuel gas manifolds to a companion one of the extension plates.

8. The line burner of claim 7, wherein at least one of the extension plates cooperates with its companion fuel gas manifold to provide spaced apart boundary walls defining a portion of the second means.

9. The line burner of claim 2, wherein each fuel gas manifold is situated adjacent to the first means and one of the second means in heat transferring relation so that heat energy from the fuel gas supplied to the fuel gas manifolds is transferred to the combustion air conducted through the first and second means to cool the fuel gas manifolds.

10. The line burner of claim 2, wherein the second means includes an angle iron aligned in spaced apart relation to each fuel gas manifold to define a bypass passageway therebetween for conducting combustion air to the second air and fuel mixing region, the angle iron includes a mounting flange connected to the burner housing to support the angle iron in the burner housing and a flow-diverting flange oriented to lie at about a right angle to the mounting flange and extend inwardly with respect to a wall of the burner housing to direct combustion air supplied by the second means inwardly toward the space provided between the two fuel gas manifolds.

11. The line burner of claim 10, wherein the second means further includes means for coupling the mounting flange to the burner housing to permit relative movement therebetween so that the flow-diverting flange is movable relative to a companion fuel gas manifold to vary the location of an outer boundary of the bypass passageway and the size of a discharge opening defined by the flow-diverting flange in cooperation with the companion fuel gas manifold through which combustion air flows to reach the second air and fuel mixing region and means for locking the mounting flange to the burner housing to locate the flow-diverting flange in a fixed position with respect to the burner housing.

12. A line burner comprising a burner housing, a pair of elongated fuel gas manifolds mounted to the burner housing and formed to include a plurality of fuel gas ports, fuel means for supplying fuel gas to the at least one fuel gas manifold, air means for supplying combustion air to fuel gas discharged from the at least one fuel gas manifold through the fuel gas ports to create an air and fuel mixture that is ignitable to produce a flame in the burner housing, a pair of chimney plates, and means for mounting the chimney plates to a top portion of the burner housing to lie in upwardly extending, vertical, spaced-apart relation and contain the at least one elongated fuel gas manifold therebetween so that the chimney plates cooperate to define a vertical flue conducting inert gases produced by combustion of the air and fuel mixture in an upward direction relative to the to portion of the burner housing and away from the flame to protect the flame from being smothered by said inert gases, the pair of elongated fuel gas manifolds being situated to form a primary airflow channel therebetween and at least one secondary airflow channel between one of the fuel gas manifolds and one of the chimney plates, each fuel gas manifold extending longitudinally along a length of the burner housing, each fuel gas manifold being arranged to cause its fuel gas ports to discharge laterally into the primary airflow channel toward the opposite manifold to provide streams of fuel gas for use in combustion, and the primary and secondary airflow channels being disposed in part in the vertical flue defined by the pair of chimney plates.

13. The line burner of claim 12, further comprising an angle iron provided in at least one of the secondary airflow channels, the angle iron including a mounting flange connected to one of the chimney plates to support the angle iron in the flue defined by the pair of chimney plates and a flow-diverting flange oriented to lie at a right angle to the mounting flange and extend inwardly with respect to said one of the chimney plates to direct combustion air supplied through said at least one of the secondary airflow channels inwardly toward the space provided between the pair of fuel gas manifolds so that combustion air sweeps around the fuel gas manifold adjacent to the angle iron and the flame.

14. The liner burner of claim 13, further comprising means for coupling the mounting flange to said one of the chimney plates to permit relative movement therebetween so that the flow-diverting flange is movable relative to a companion fuel gas manifold to vary the size of a discharge opening defined by the flow-diverting flange in cooperation with the companion fuel gas manifold through which combustion air flows to reach the mixing region and means for locking the mounting flange to said one of the chimney plates to locate the flow-diverting flange in a fixed position with respect to said one of the chimney plates.

15. A line burner comprising a burner housing, a pair of fuel gas manifolds situated to lie in spaced relation inside the burner housing, means for supplying fuel gas to the pair of fuel gas manifolds, means for mounting the pair of fuel gas manifolds in the burner housing to form a primary airflow channel located between the fuel gas manifolds and a secondary airflow channel located between at least one of the fuel gas manifolds and the burner housing, each fuel gas manifold extending longitudinally along a length of the burner housing, and each fuel gas manifold being formed to include a plurality of fuel gas ports discharging laterally into the primary airflow channel and toward the opposite manifold to provide streams of fuel gas for use in combustion, first means for supplying combustion air via the primary airflow channel to fuel gas discharged from the fuel gas manifolds through fuel gas ports to create an air and fuel mixture that is ignitable to produce a flame in the burner housing adjacent to the pair of fuel gas manifolds, and means for delivering a stream of combustion air into the secondary airflow channel to place the stream of combustion air in contact with at least a portion of the fuel gas manifolds so that the fuel gas manifolds are convectively cooled by the stream of combustion air during combustion of the air and fuel mixture in the burning housing.

16. The line burner of claim 15, further comprising an angle iron including a mounting flange connected to the burner housing to support the angle iron in spaced relation to one of the fuel gas manifolds to define one of the secondary airflow channels therebetween and a flow-diverting flange oriented to lie at a right angle to the mounting flange and extend inwardly with respect to the burner housing to direct combustion air delivered into the secondary airflow channel to said one of the fuel gas manifolds.

17. The line burner of claim 16, further comprising means for coupling the mounting flange to said burner housing to permit relative movement therebetween so that the flow-diverting flange is movable relative to a companion fuel gas manifold to vary the size of a discharge opening defined by the flow-diverting flange in cooperation with the companion fuel gas manifold through which combustion air flows to reach the air and fuel mixture and means for locking the mounting flange to said one of the chimney plates to locate the flow-diverting flange in a fixed position with respect to said one of the chimney plates.

18. A line burner comprising a burner housing, a pair of fuel gas manifolds situated to lie in spaced relation inside the burner housing, means for supplying fuel gas to the pair of fuel gas manifolds, means for mounting the pair of fuel gas manifolds in the burner housing to form a primary airflow channel located between the fuel gas manifolds and a secondary airflow channel located between at least one of the fuel gas manifolds and the burner housing, each fuel gas manifold extending longitudinally along a length of the burner housing, and each fuel gas manifold being formed to include a plurality of fuel gas ports discharging laterally into the primary airflow channel and toward the opposite manifold to provide streams of fuel gas for use in combustion, first means for supplying combustion air via the primary airflow channel to fuel gas discharged from the fuel gas manifolds through fuel gas ports to create an air and fuel mixture that is ignitable to produce a flame in the burner housing adjacent to the pair of fuel gas manifolds, and means for cooling the pair of fuel gas manifolds heated during combustion of the air and fuel mixture in the burner housing to prolong the life of the pair of fuel gas manifolds, the cooling means including means for delivering combustion air into the secondary airflow channel and means for conducting combustion air in the secondary airflow channel across the pair of fuel gas manifolds to promote heat loss from the pair of fuel gas manifolds by convection.

19. The line burner of claim 18, further comprising an angle iron including a mounting flange connected to the burner housing to support the angle iron in spaced relation to one of the fuel gas manifolds to define one of the secondary airflow channels therebetween and a flow-diverting flange oriented to lie at a right angle to the mounting flange and extend inwardly with respect to the burner housing to direct combustion air delivered into the secondary airflow channel to said one of the fuel gas manifolds.

20. The line burner of claim 19, further comprising means for coupling the mounting flange to said burner housing to permit relative movement therebetween so that the flow-diverting flange is movable relative to a companion fuel gas manifold to vary the size of a discharge opening defined by the flow-diverting flange in cooperation with the companion fuel gas manifold through which combustion air flows to reach the air and fuel mixture and means for locking the mounting flange to said one of the chimney plates to locate the flow-diverting flange in a fixed position with respect to said one of the chimney plates.

21. A line burner, comprising a burner housing including a side wall, a pair of elongated fuel gas manifolds positioned inside the burner housing, each fuel gas manifold being arranged to extend longitudinally along a length of the burner housing in spaced-apart relation to the side wall to define a longitudinally extending air exhaust opening therebetween, each fuel gas manifold being formed to include a plurality of fuel gas ports discharging into the burner housing into a central region of the burner housing in a direction away from said opening, fuel means for supplying fuel gas to the fuel gas manifolds, means for supplying combustion air through a primary airflow channel to said central region to mix with fuel gas discharged from the fuel gas manifolds through the fuel gas ports to create an air and fuel mixture in the central region that is ignitable to produce a flame in the housing, and means for passing combustion air through a secondary airflow channel provided by the longitudinally extending air exhaust opening defined between each fuel gas manifold and the burner housing to provide an airstream of combustion air in a downstream region in the burner housing between the flame and the side wall of the burner housing, the pair of elongated fuel gas manifolds being mounted in the burner housing to form the primary airflow channel therebetween leading to said central region, each fuel gas manifold being arranged to cause its fuel gas ports to discharge laterally into the primary airflow channel toward the opposite manifold to provide streams of fuel gas for mixing with combustion air in the central region.

22. The line burner of claim 21, wherein each fuel gas manifold lies in spaced-apart relation to a side wall of the burner housing to define of the said secondary airflow channels therebetween and the secondary airflow channels lie on opposite sides of the primary airflow channel.

* * * * *